US008127642B2

(12) United States Patent
Creech et al.

(10) Patent No.: US 8,127,642 B2
(45) Date of Patent: Mar. 6, 2012

(54) FUSE BARREL COMPONENT HANDLING DEVICE

(76) Inventors: Garry Creech, McKee, KY (US); Edward R. Judd, Tyner, KY (US)

( * ) Notice: Subject to any disclaimer, the term of this patent is extended or adjusted under 35 U.S.C. 154(b) by 135 days.

(21) Appl. No.: 12/607,289

(22) Filed: Oct. 28, 2009

(65) Prior Publication Data

US 2011/0094342 A1 Apr. 28, 2011

(51) Int. Cl.
*H01H 85/02* (2006.01)
*B25B 27/14* (2006.01)

(52) U.S. Cl. ..... 81/3.8; 81/53.1

(58) Field of Classification Search ..... 81/3.8, 81/53.1; 294/19.1

See application file for complete search history.

(56) References Cited

U.S. PATENT DOCUMENTS 2,299,838 A * 10/1942 Mays ..... 81/53.1
2,552,015 A * 5/1951 Quick ..... 294/19.1
4,132,441 A * 1/1979 Watkins ..... 81/3.8
4,244,613 A * 1/1981 Tillman ..... 81/3.8
6,474,197 B1 11/2002 Browen et al.

OTHER PUBLICATIONS

Hastings Incorporated, Fuse Claw, www.hfgp.com/images.catalog/F-12.gif printed Dec. 10, 2008.

* cited by examiner

*Primary Examiner* — Hadi Shakeri
(74) *Attorney, Agent, or Firm* — Frost Brown Todd LLC

(57) ABSTRACT

A fuse barrel component handling device is configured to engage and support both load break and non-load break fuse barrel components. The fuse barrel component handling device includes a hollow cavity capable of receiving a portion of a fuse barrel. In addition, the handling device has a projection bar, which may be integral with or attached to the device, and at least two slots and a notch within the wall of the device. The projection bar, at least two slots, and notch receive and support a fuse barrel component, e.g. a pull ring of a non-load break component or a hook member of a load-break component. The fuse barrel component handling device may be used with a hot stick to remove and/or install a fuse barrel.

8 Claims, 15 Drawing Sheets

FUSE BARREL COMPONENT HANDLING DEVICE

FIELD OF INVENTION

Embodiments of the present invention relate in general to a system for installing and removing a fuse barrel component, and more particularly to a fuse barrel component handling device that engages and supports both load break and non-load break fuse barrel components.

BACKGROUND

Fuse barrels are typically positioned in electric circuits. A fuse barrel, which may be suspended from power lines by an upper support member and a lower support member, may include various types of components, e.g., a load break cutout, non-load break cutout, load break sectionalizer, and non-load break sectionalizer. A fuse barrel also may include an insulated fuse tube and a fuse link that allows current to flow through the barrel. When currents of normal levels are flowing through the electric circuit, the fuse link will be unaffected and the fuse barrel will remain in a cutout configuration. However, when a fault or an over-current occurs in the circuit, the fuse link will react, causing an interruption of the current in the circuit. As a result of the reaction of the fuse link, the "blown" fuse tube will be disengaged from the upper support member and will rotate downward into a "drop down" position, breaking the circuit. In the "drop down" position, the fuse link may be said to be in the sectionalizer configuration.

A number of tools and methods have been developed to remove these old or "blown" fuse barrels and to install new fuse barrels. In one such method, a utility worker may use a hook-shaped tool attached to a "hot stick," or other suitable device, to engage the trunnion of the old fuse barrel. As used herein, a hot stick or "extendo stick" refers to a telescoping probe that extends from about 4-5 feet, for example, to about 35-40 feet, or any other suitable distance based on the particular application where the device is being used. These types of devices may allow a utility worker to remove and/or install a fuse barrel located on a distribution electrical line atop a utility pole. Once the trunnion of the fuse barrel is engaged, the hot stick may be maneuvered to allow the old fuse barrel to be lifted from the lower support member. The utility worker may then lower the old fuse barrel to the ground and remove the old fuse barrel from the hot stick. A trunnion of the replacement fuse barrel may be engaged by the hook on the hot stick, and the hot stick can be maneuvered to position the lower end of the new fuse barrel on the lower support member. The fuse barrel may then be rotated upward until the upper end is secured into the upper support member, closing the circuit.

It may be very difficult to control a fuse barrel on a hot stick while lifting the stick 20 or 30 feet, for example, in the air to reach the top of a utility pole. The success of the installation or removal may depend on balancing the fuse barrel or a component of the fuse barrel upon the hot stick or the hook-shaped tool attached to the hot stick. Because the engagement of the fuse barrel and the hook-shaped tool may be wobbly or insecure, the fuse barrel may slip off the hot stick and fall to the ground, possibly causing damage to the fuse barrel itself and/or injury to the utility worker or other persons in the area. Thus, it may be advantageous to install and/or remove a fuse barrel using a device that more securely engages the fuse barrel.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. It is understood, however, that the described embodiments are not limited to the precise arrangements shown. In the drawings, like numerals represent like elements throughout the several views.

DETAILED DESCRIPTION

The following description of certain examples should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Versions of the present invention comprise a fuse barrel component handling device, which may be used to securely engage and support a fuse barrel. Such a fuse barrel component handling device may be attached to a hot stick to permit a utility worker to remove and/or install a fuse barrel. The fuse barrel component handling device may be used in conjunction with various types of fuse barrel components as will be apparent to one of ordinary skill in the art. For example, the fuse barrel component handling device may be used to install and/or remove a load break cutout, a non-load break cutout, a load break sectionalizer, and a non-load break sectionalizer.

Figure 1:
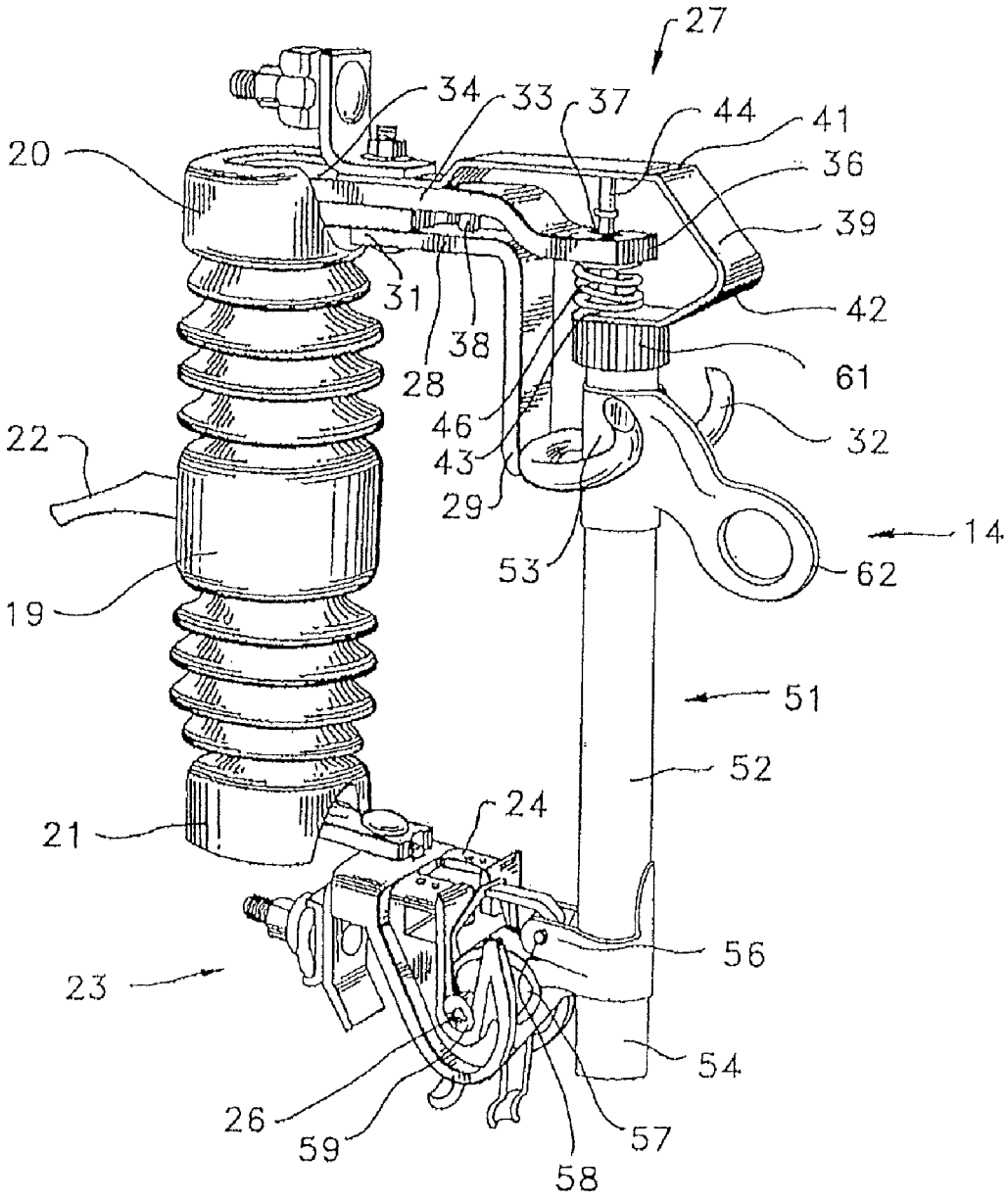
FIG. 1 depicts an isometric view of an exemplary non-load break fuse barrel component.
Figure 2:
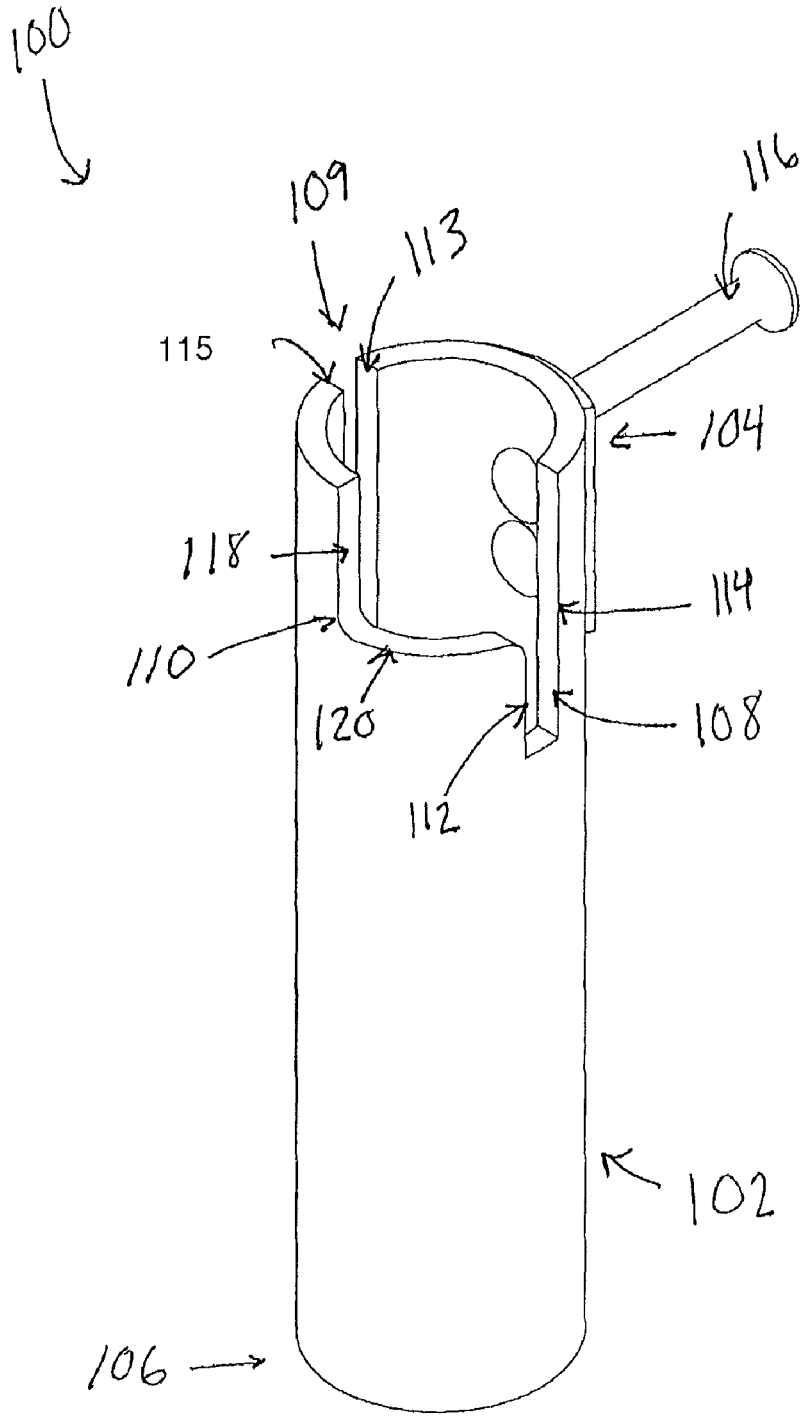
FIG. 2 depicts an isometric view of an exemplary fuse barrel component handling device.

Referring to FIG. 1, one example of a fuse barrel is shown. In this example, the fuse barrel comprises a non-load break cutout (14). Because cutout (14) is a conventional component that is well known in the art, only a brief description of this device will be provided. One such cutout (14) is disclosed in U.S. Pat. No. 6,474,197 (issued to Browen et al. on Nov. 5, 2002), which is herein incorporated by reference. The cutout (14) includes an elongated insulator (19) having an upper end (20) and a lower end (21). Attached to the insulator (19) is a mounting member (22) that can facilitate mounting of the cutout (14) to a cross arm of a utility pole. A lower contact assembly (23) is attached to the lower end (21) of the insulator (19). The lower contact assembly (23) includes a lower support member (24). Formed in the lower support member (24) are two pockets (26).

Attached to the upper end (20) of the insulator (19) is an upper contact assembly (27). The upper contact assembly (27) includes a support bar (28) that has a first segment (29) that is bent downward at about a 90° angle from a second segment (31). The first segment (29) of the support bar (28) includes two attachment hooks (32). The upper contact assembly (27) also includes an offset recoil bar (33) that has a first end (34) adjacent the insulator (19) and a second end (36). A bore (37) extends through the second end (36) of the recoil bar (33). The recoil bar (33) is attached to, and spaced apart from, the second segment (31) of the support bar (28) by a rivet (38).

Also included in the upper contact assembly (27) is a generally J-shaped spring contact (39). The spring contact (39) includes a long leg (41) and a short leg (42). Included on the end of the short leg (42) of the spring contact (39) is an indentation (43) that extends toward the long leg (41). A stud (44) extends through the bore (37) of the recoil bar (33) and is firmly attached between the legs (41)-(42) of the spring contact (39). The stud (44) is received in the indentation (43) formed in the short leg (42). Thus, although the spring contact (39) may flex, the legs (41)-(42), which are interconnected by the stud (44), are constrained to move in unison. Positioned between the second end (36) of the recoil bar (33) and a base of the indentation (43), is a spring (46) that sets a rest position for the legs (41)-(42) of the spring contact (39).

Non-load break cutout (14) also includes a fuse tube (51). The fuse tube (51) has an insulated body member (52). The fuse tube (51) includes an upper end (53) and a lower end (54). Attached to the lower end (54) of the fuse tube (51) is a cast component (56). A trunnion casting (57) is pivotally mounted at a toggle joint (58) to the cast component (56). Extending from the trunnion casting (57) are a pair of bosses (59). The bosses (59) are configured to be received by the pockets (26) in the lower support member (24). Thus, the lower end (54) of the fuse tube (51) can be supported by the lower contact assembly (23).

Mounted on the upper end (53) of the fuse tube (51) is a contact cap (61). The contact cap (61) is configured to fit into and be held by the indentation (43) formed in the short leg (42) of the spring contact (39). Extending from the upper end (53) of the fuse tube (51) is a pull ring (62). The upper end (53) of the fuse tube (51) is held, and latched against movement, by the upper contact assembly (27).

Figure 3:
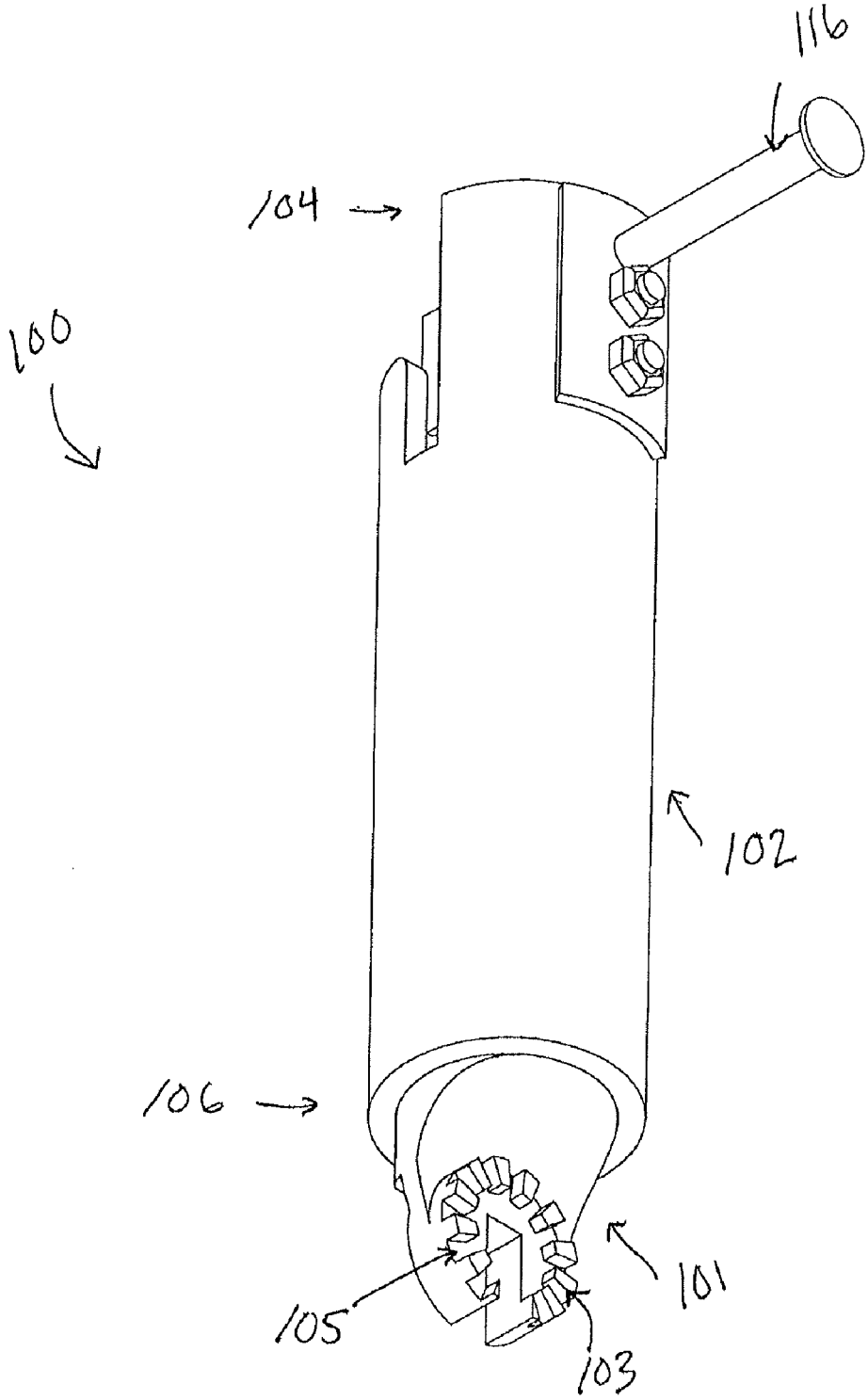
FIG. 3 depicts an isometric view of the fuse barrel component handling device of FIG. 2 with an adapter.
Figure 4:
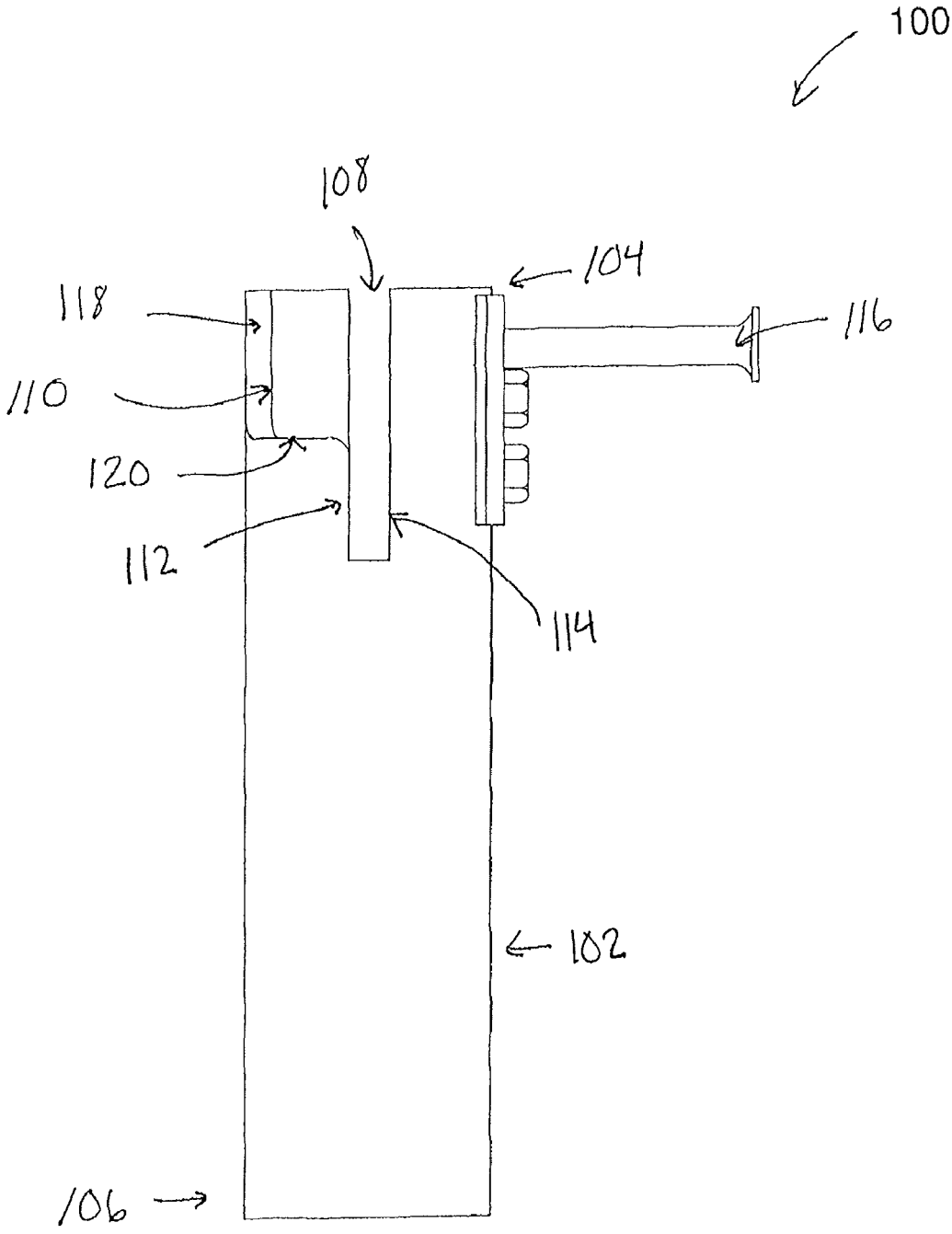
FIG. 4 depicts a front elevation view of the fuse barrel component handling device of FIG. 2.
Figure 5:
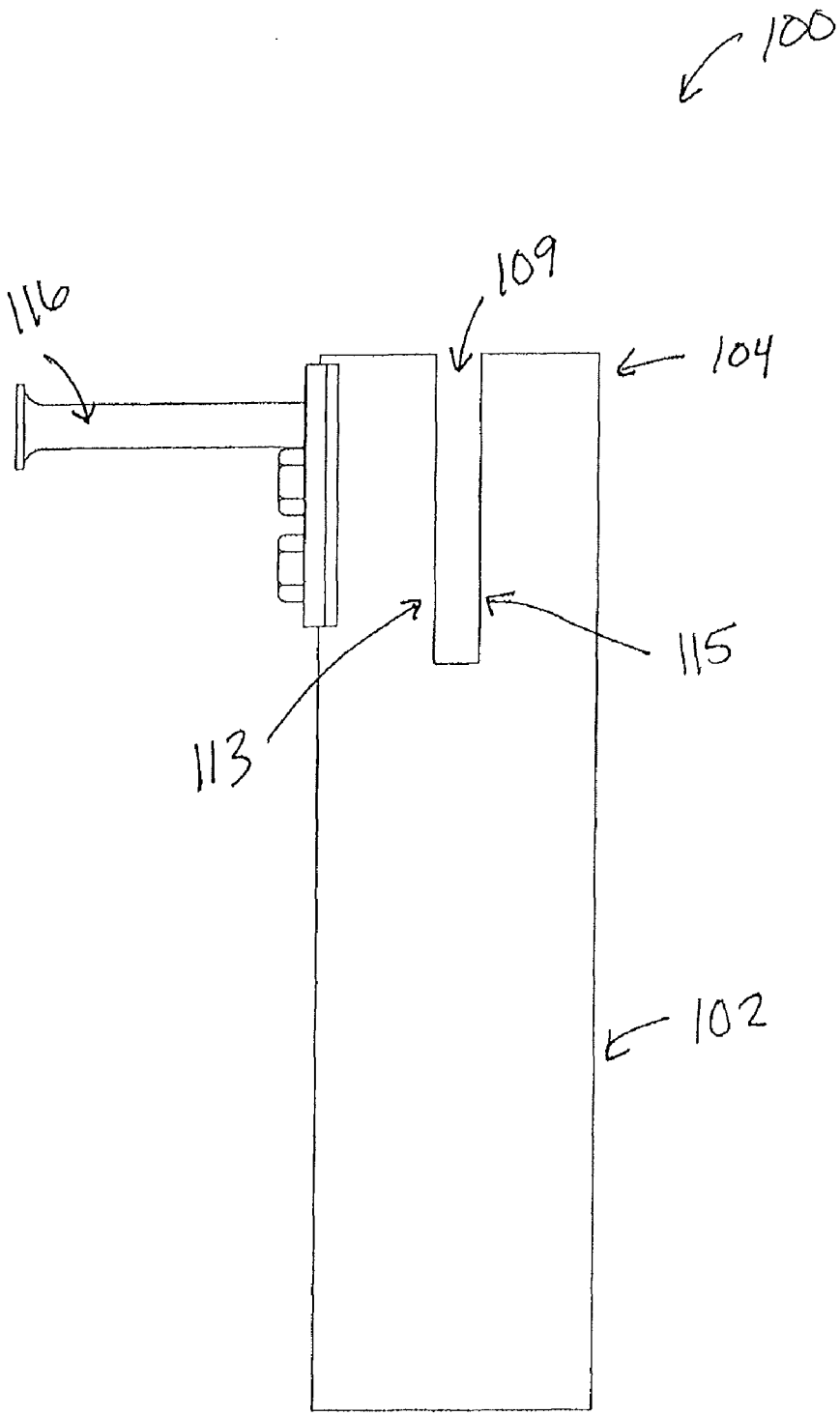
FIG. 5 depicts a rear elevation view of the fuse barrel component handling device of FIG. 2.
Figure 6:
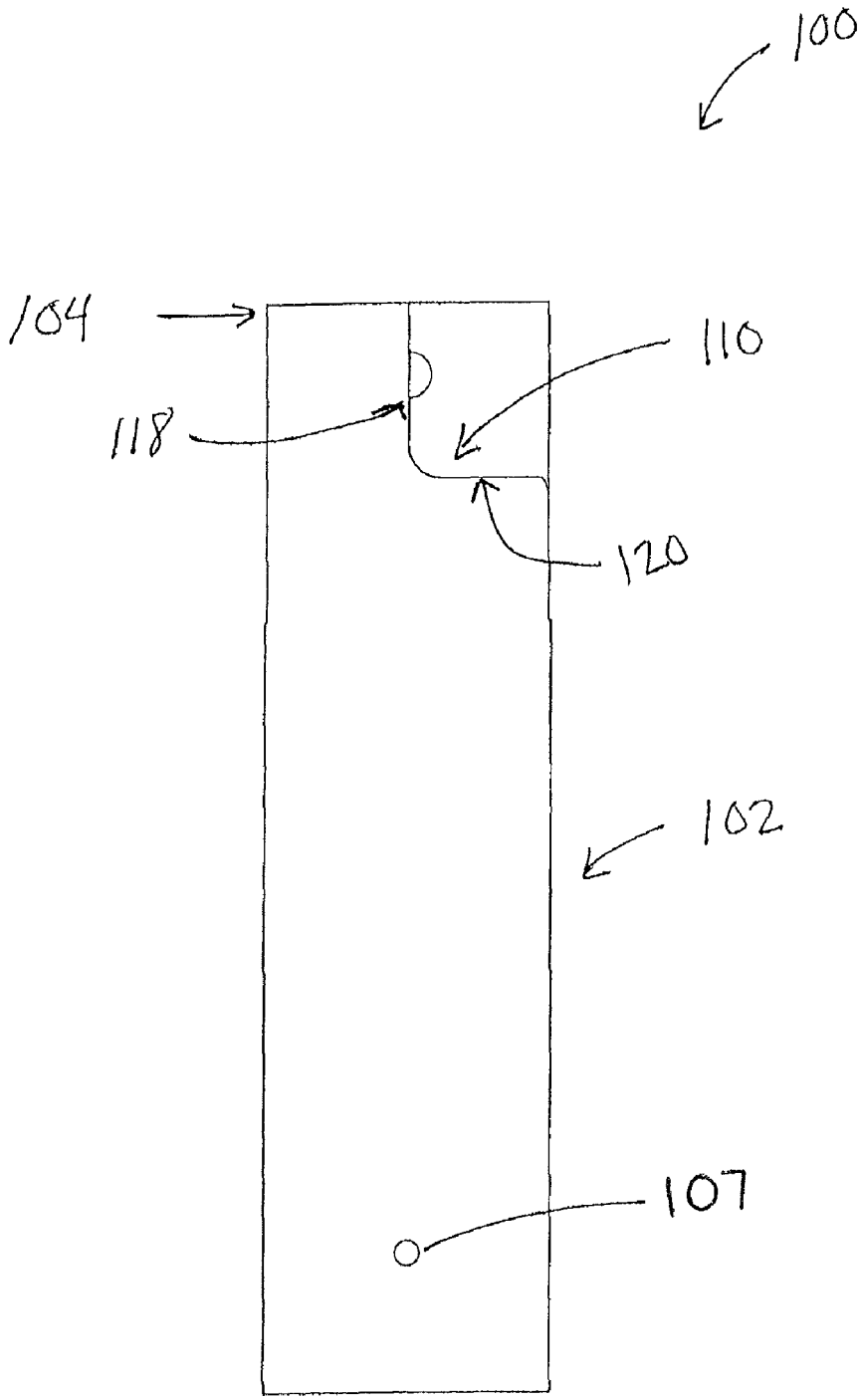
FIG. 6 depicts a side elevation view of the fuse barrel component handling device of FIG. 2.
Figure 7:
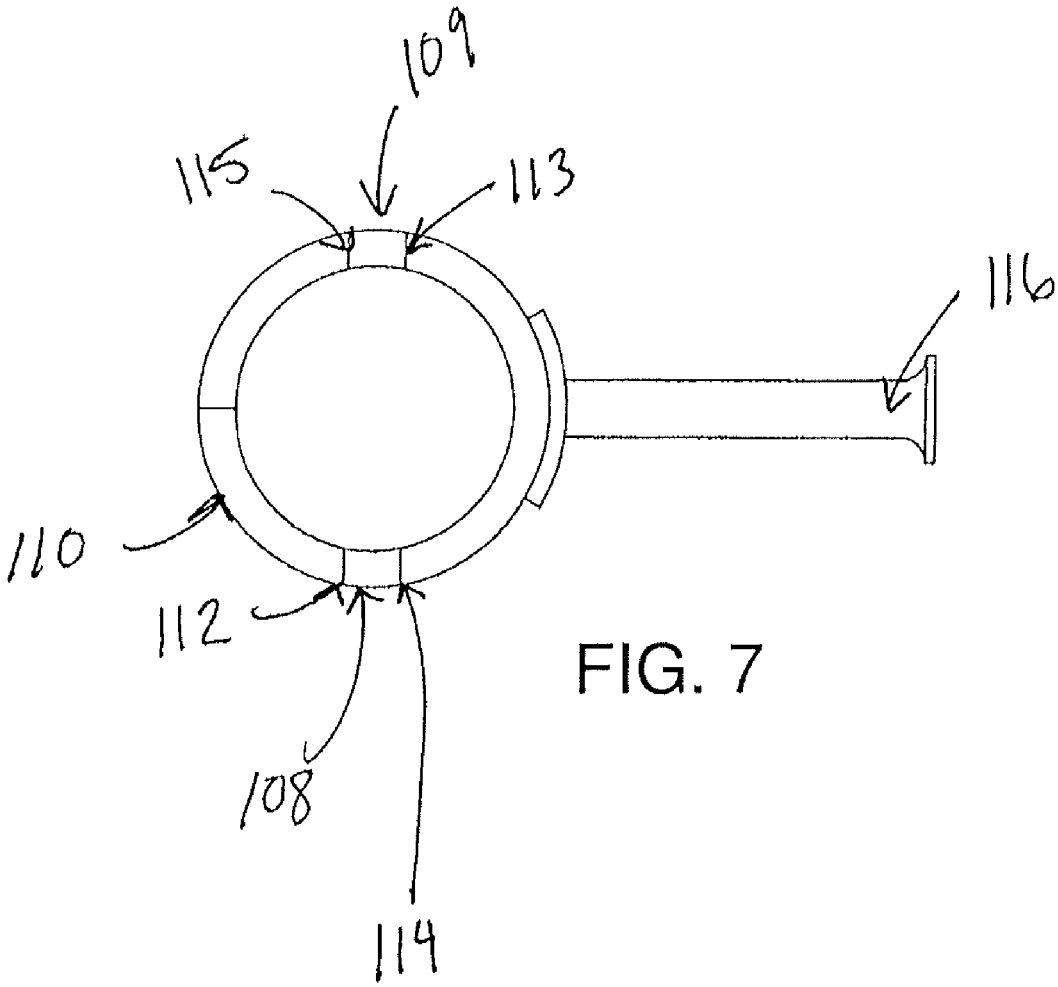
FIG. 7 depicts a top plan view of the fuse barrel component handling device of FIG. 2.

Referring to FIGS. 2-7, one embodiment of a fuse barrel component handling device (100) is illustrated. Handling device (100) comprises a generally cylindrical body (102) having a first end (104) and a second end (106). The first end (104) of device (100) is open to engage with a fuse barrel, for example, non-load break cutout (14). The second end (106) of device (100) may be either open or closed and configured to engage with a hot stick (not pictured). As shown in FIG. 3, the second end (106) may also have an attached adapter (101) that is configured to be releasably secured to a hot stick. Adapter (101) may comprise a plurality of teeth (103) spaced apart by a plurality of notches (105), both of which may be oriented to be secured to a hot stick. Such an adapter (101) may be integral to second end (106) or it may be attached to body (102) with any suitable fastener, such as a weld, bolt, screw, or adhesive, as will be apparent to one of ordinary skill in the art. If the adapter (101) is integral to body (102), device (100) may be manufactured, for example, via an injection molding process. As shown in FIG. 6, cylindrical body (102) may also comprise a dowel pin (107) to secure the device (100) to a hot stick (not pictured). Another illustrative example of an adapter is the adapter (92) shown and described in Browen et al. (FIG. 4, Col. 4 lines 6-14), which is herein incorporated by reference. Body (102) may be manufactured from any suitable material as will be apparent to one of ordinary skill in the art. For example, body (102) may be made of a material with low conductivity, such as PVC or other polymeric material. In addition, although other suitable dimensions may be used, the length of exemplary body (102) from first end (104) to second end (106) may be approximately 8.5 inches. And if body (102) is generally cylindrical in shape, it may have an outside diameter of approximately 1.875 inches while the inside diameter may be approximately 1.5 inches. Of course, these particular dimensions are not required.

Figure 14:
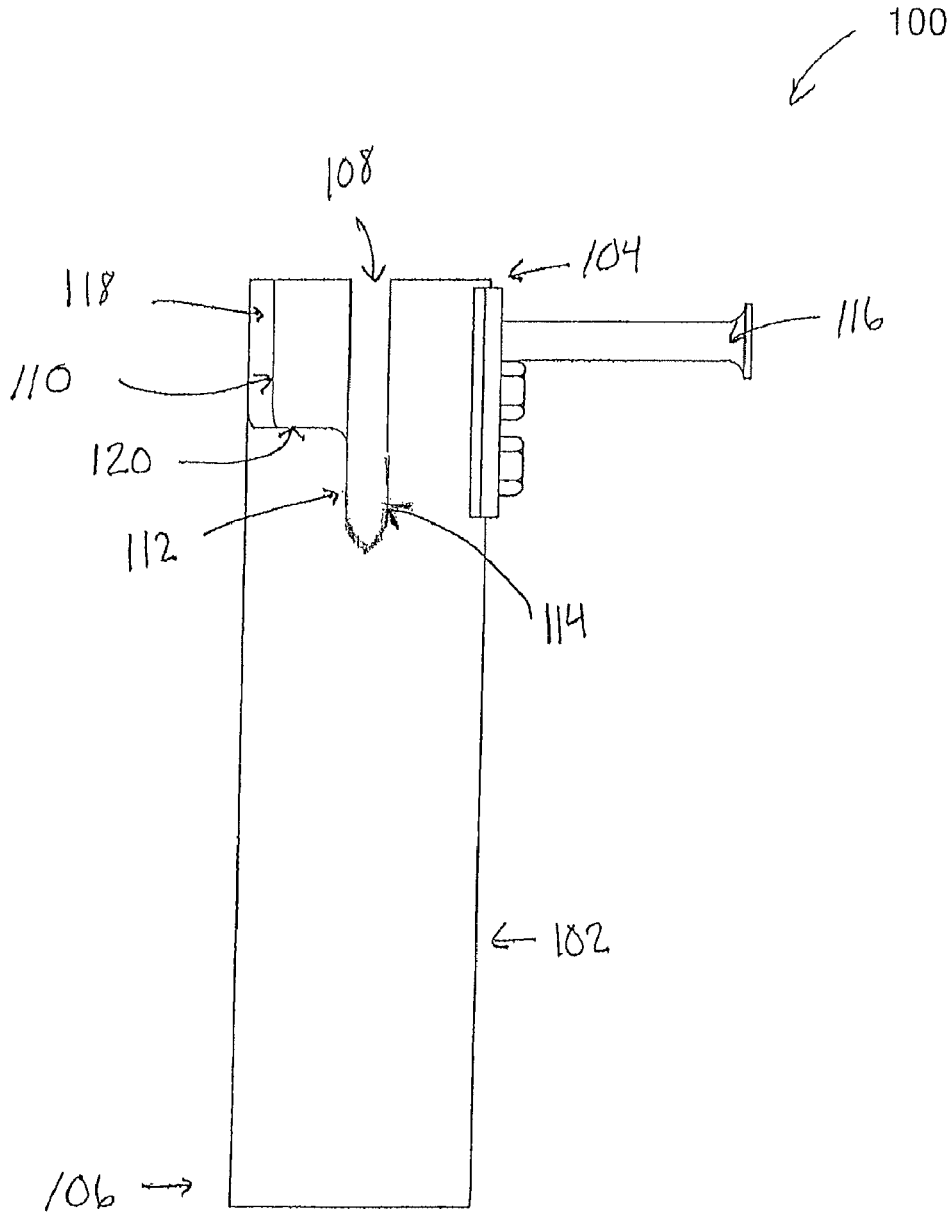
FIG. 14 depicts a front elevation view of an alternate embodiment of the fuse barrel component handling device of FIG. 2, wherein the device includes a first slot and a second slot that are substantially oval shaped.
Figure 15:
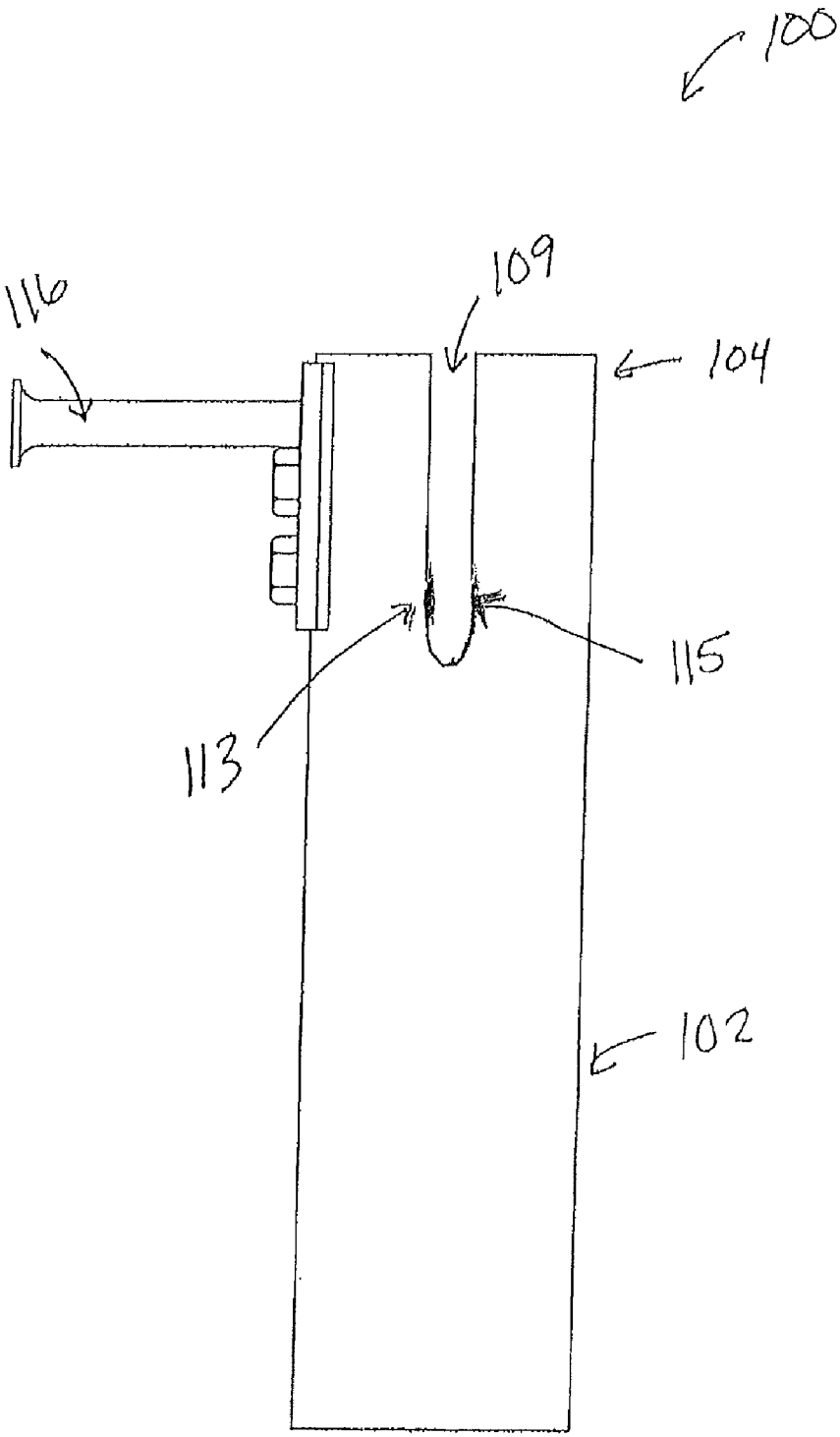
FIG. 15 depicts a rear elevation view of the fuse barrel component handling device of FIG. 14.

In the illustrated version, handling device (100) also comprises at least a first slot (108) and a second slot (109). First slot (108) and second slot (109) are generally located at the first end (104) of body (102). In this example, first slot (108) and second slot (109) extend from the open first end (104) along a portion of the wall of body (102). As shown, second slot (109) comprises two edges (113, 115) that are approximately the same length, which may, for example be 2.0 inches. In this version, first slot (108) also comprises two edges (112, 114), but they are of two different lengths. By way of example only, the length of edge (112) may be 0.75 inches while the length of edge (114) may be 2.0 inches. In addition, although merely illustrative, the width of both first slot (108) and second slot (109) between their respective edges (112, 114, 113, 115) may be 0.3125inches. The edges (112, 114, 113, 115) of first slot (108) and second slot (109) may be beveled, and although in the present embodiment first slot (108) and second slot (109) are substantially rectangular in shape, they may take any other suitable shape as will be apparent to one of ordinary skill in the art. By way of example only, first slot (108) and second slot (109) may be substantially oval shaped, as shown in FIGS. 14 and 15.

In the illustrated embodiment, first slot (108) and second slot (109) are positioned substantially diametrically opposed to each other in body (102). In this way, first slot (108) and second slot (109) in body (102) may permit the device (100) to engage and support both load break and non-load break fuse barrel components. For example, the dual slot configuration of the illustrated version may permit a pull ring to be received and engaged within first slot (108) and second slot (109) as illustrated in FIGS. 8-11. In another example, first slot (108) and second slot (109) may receive and engage a hook member from a load break or non-load break fuse barrel sectionalizer component as illustrated in FIGS. 10-11.

As shown in the figures, handling device (100) also comprises a notch (110). Notch (110) is a substantially U-shaped cutout having edges (118, 120) located at the first end (104) of body (102). In the present version, notch (110) extends from the open first end (104) and down through a portion of the wall of body (102). In particular, notch (110) may be in communication with first slot (108), accounting for the generally shorter length of edge (112) as compared to edge (114). Edges (118, 120) of notch (110) may be beveled to help guide a fuse barrel component into device (100). In addition, although merely illustrative, the length of edge (118) may be 1.0 inch and the length of edge (120) may be 1.25 inches. Edges (118, 120) may also be contoured to provide further stability when using the device (100) to install and/or remove a fuse barrel component.

Like first slot (108) and second slot (109), notch (110) may be sized and shaped to allow the device (100) to receive and support both load break and non-load break fuse barrel components. In particular, the U-shaped notch (110) may provide a seat upon which at least a portion of a fuse tube or a fuse barrel component, such as the hook portion or pull ring of a non-load break component, may rest while the fuse barrel is being installed and/or removed. For example, notch (110), in combination with first slot (108) and second slot (109) may receive a hook member from a load break or non-load break fuse barrel sectionalizer component as shown in FIGS. 10-11. In another example, notch (110) may engage a pull ring of a fuse barrel component. In still another example, a fuse barrel (230) may be supported by notch (110) to direct the fuse barrel (230) to the upper contact assembly (232).

In the exemplary embodiment, handling device (100) also comprises a projection bar (116). Such a projection bar (116) may be located at the first end (104) of body (102). Bar (116) may be integral to the first end (104) or it may be attached to body (102) with any suitable fastener, such as a weld, bolt, screw, or adhesive, as will be apparent to one of ordinary skill in the art. If bar (116) is integral to body (102), device (100) may be manufactured, for example, via an injection molding process. Although merely illustrative and while other dimensions may be suitable, the length of projection bar (116) may be 2.25 inches. A bar (116) may be utilized to engage a fuse barrel component. For example, bar (116) may be inserted into a pull ring (62) to swing the component upward to close an interrupted circuit. In another example, bar (116) may be inserted into pull ring (62) to remove a fuse barrel component from a utility line.

Figure 8:
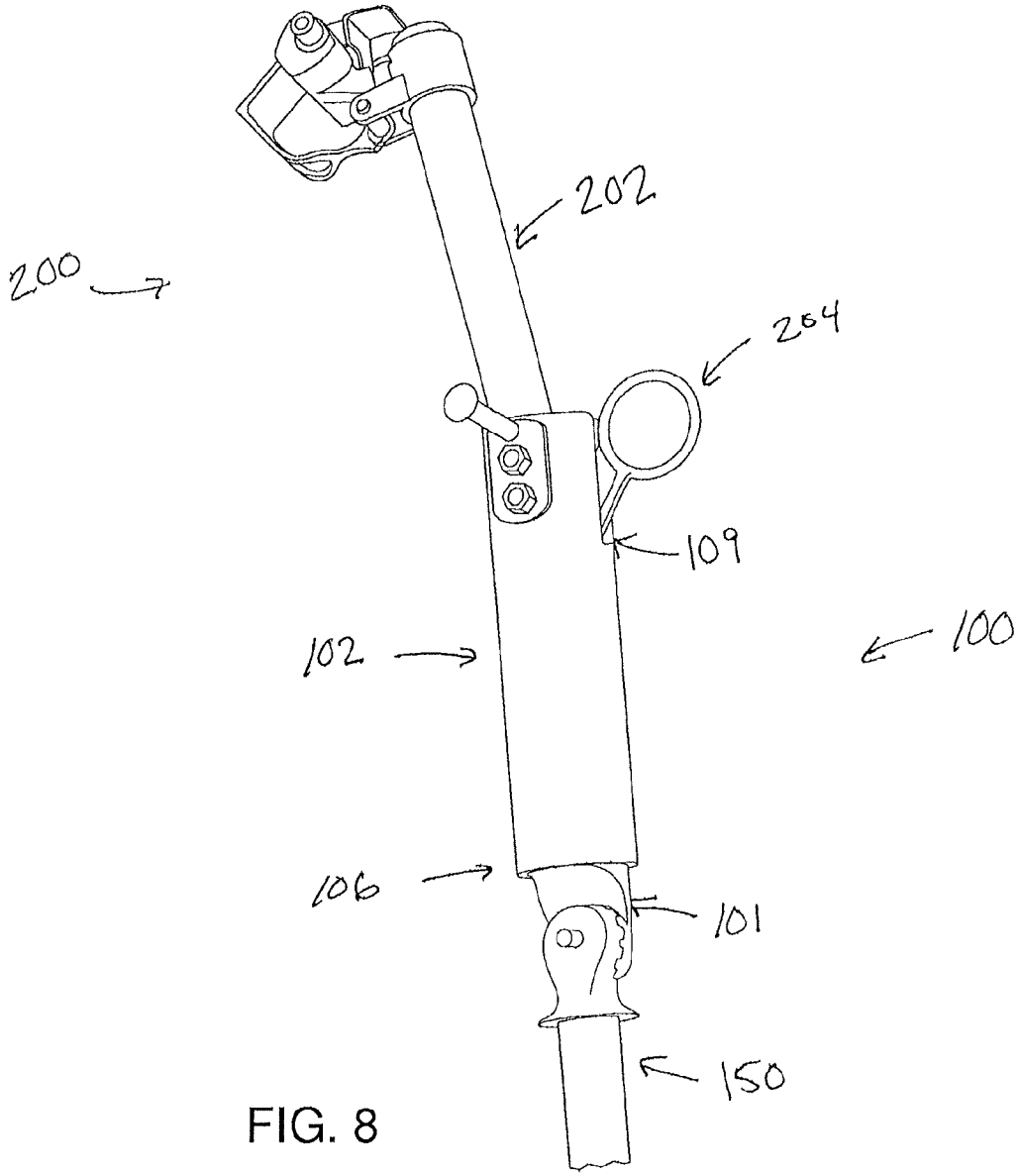
FIG. 8 depicts an isometric view of the fuse barrel component handling device of FIG. 2 engaged with a non-load break cutout.
Figure 9:
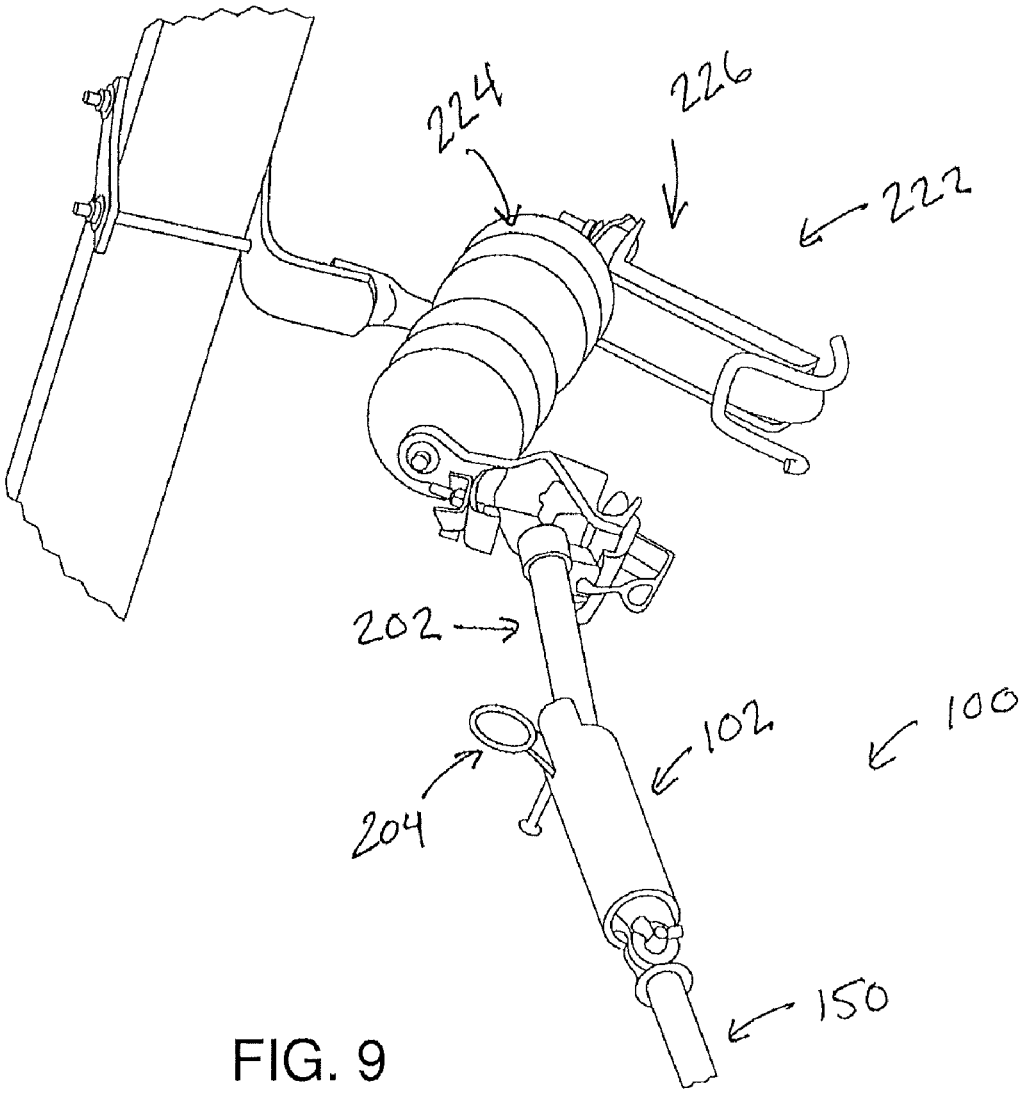
FIG. 9 depicts an isometric view of the fuse barrel component handling device of FIG. 3 during installation/removal of a non-load break cutout.
Figure 10:
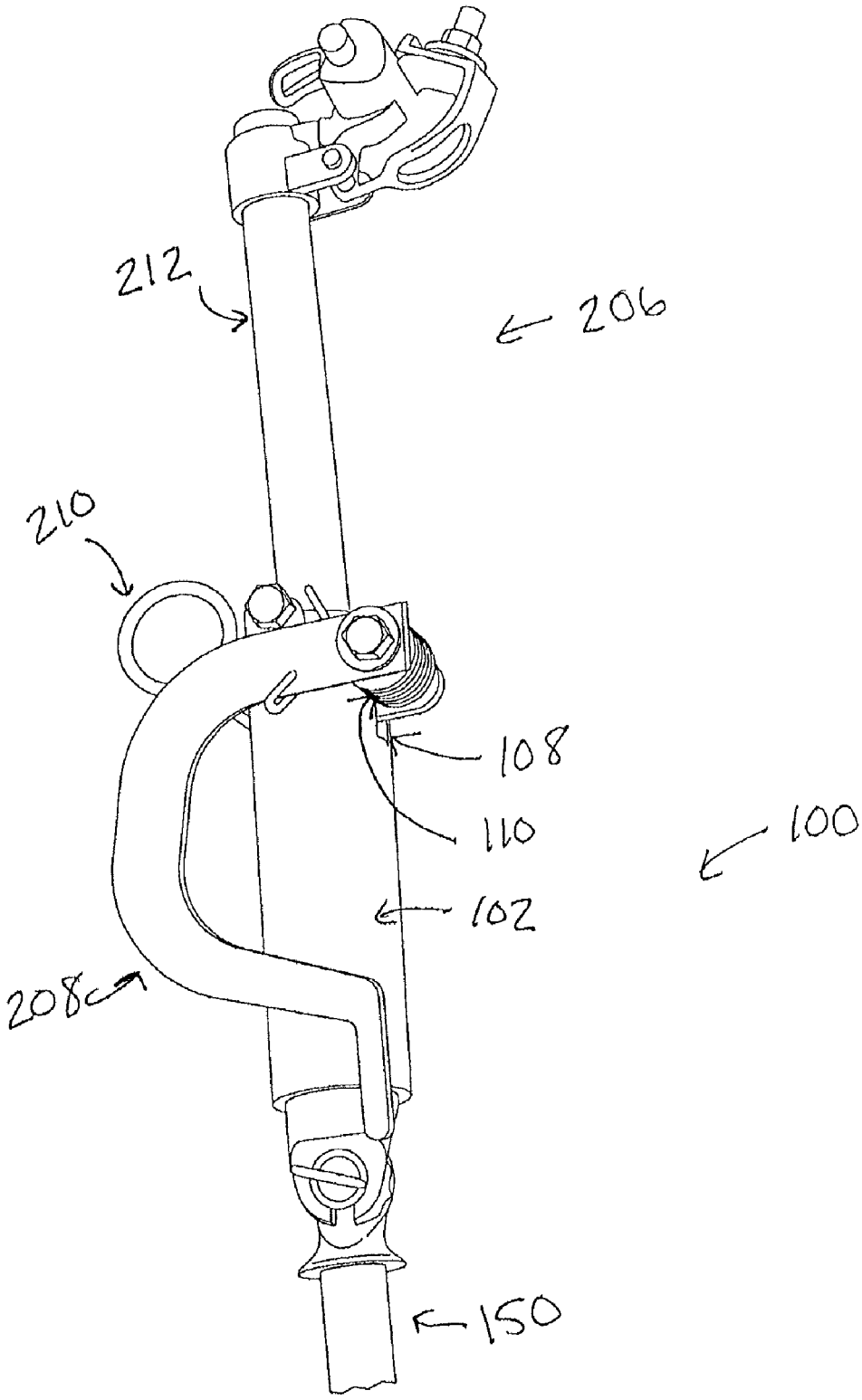
FIG. 10 depicts an isometric view of the fuse barrel component handling device of FIG. 2 engaged with a load break cutout.
Figure 11:
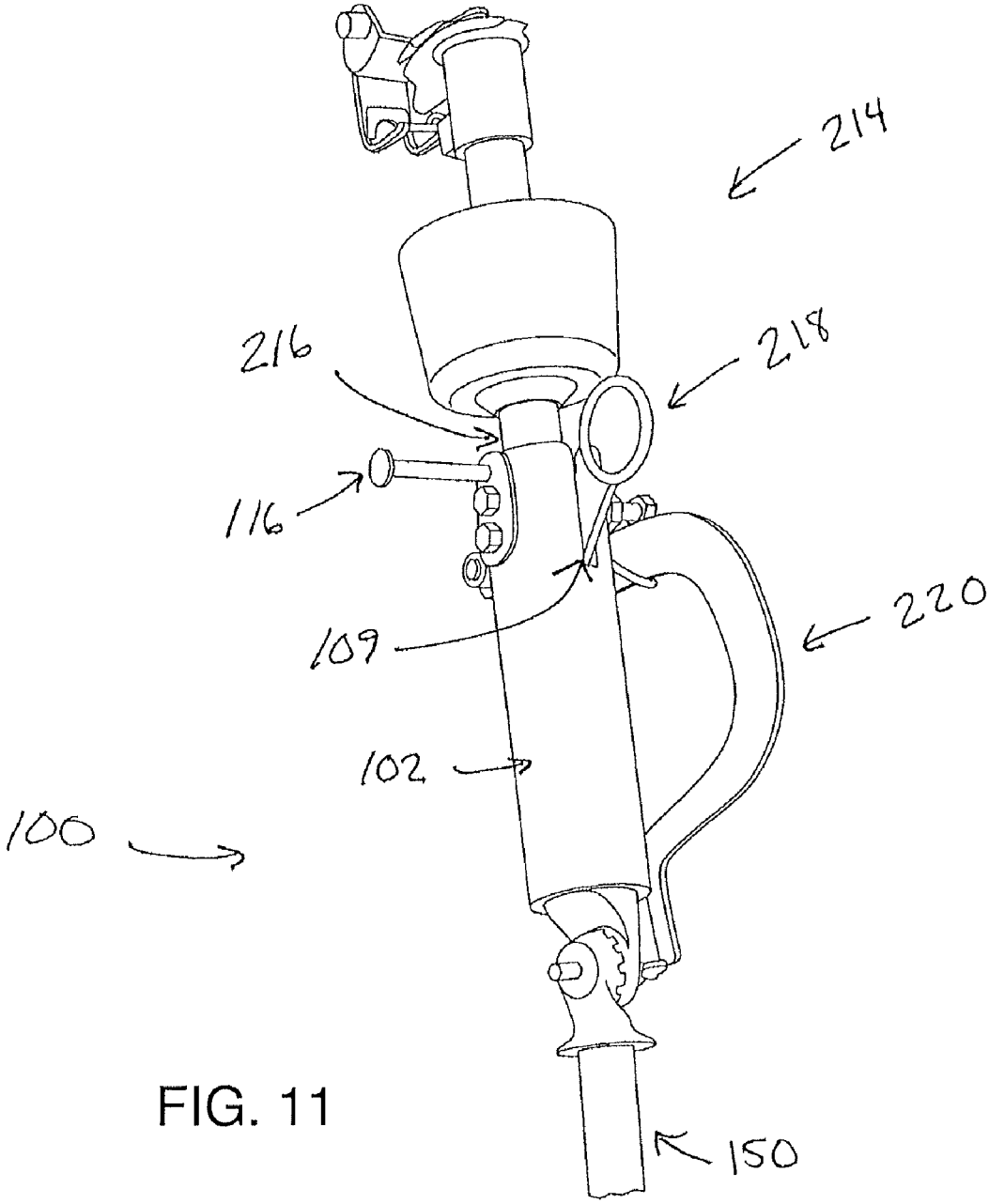
FIG. 11 depicts an isometric view of the fuse barrel component handling device of FIG. 2 engaged with a load break sectionalizer.

FIGS. 8-13 showcase the various manners in which device (100) may interact with a fuse barrel component, such as a a load break cutout, non-load break cutout, load break sectionalizer, and non-load break sectionalizer. Of course, it should be understood that handling device (100) may be used in other suitable manners and its utilization should not be limited to those situations explained in the present examples. Referring to FIG. 8, handling device (100) is shown engaging a non-load break cutout (200). As can be seen in the figure, handling device (100) is attached to adaptor (101) at its second end (106), and the adaptor (150) is further secured to hot stick (150). In the illustrative version, cutout (200) comprises a fuse tube (202) and a pull ring (204). Fuse tube (202) may be received by and rest inside body (102) of device (100) while pull ring (204) may be received by and rests in and extends through slot (109). In this way, device (100) and hot stick (150) may be raised to install and/or remove the non-load break cutout (200) from a power line. FIG. 9 shows an example of such an installation and/or removal. In the figure, the device (100) is utilized to install and/or remove the fuse tube (202) from the remainder of the fuse barrel (222), which may include elongated insulator (224) and upper contact assembly (226).

In similar fashion, device (100) may be used to engage with a load break cutout, such as the load break cutout (206) depicted in FIG. 10. As shown in the figure, load break cutout (206) comprises a fuse tube (212), hook member (208), and pull ring (210). Fuse tube (212) may be received by and positioned within body (102) of device (100) while pull ring (210) may be received by and rests and extends through second slot (109) and the hook member (208) extends and rests through both first slot (108) and notch (110). In particular, the hook member (208) may be secured in a U-shaped contour of edge (120) of notch (110). In this way, device (100) and hot stick (150) may be raised to install and/remove the load break cutout (206) from a power line.

Referring to FIG. 11, device (100) may also be utilized to engage with a sectionalizer component, such as load break sectionalizer (214). As shown in the figure, load break sectionalizer (214) may comprise a fuse tube (216), a pull ring (218), and a hook member (220). Fuse tube (216) may be received by and positioned within the body (102) of device (100) while the pull ring (218) may be received by and engage second slot (109) and the hook member (220) may be received by and rests and extends through first slot (108) and notch (110). In this way, device (100) and hot stick (150) may be raised to install and/remove the load break sectionalizer (214) from a power line. Although shown in FIG. 11 as engaging a load break sectionalizer (214), device (100) may also be used with a non-load break sectionalizer, as will be appreciated by one of ordinary skill in the art.

Figure 12:
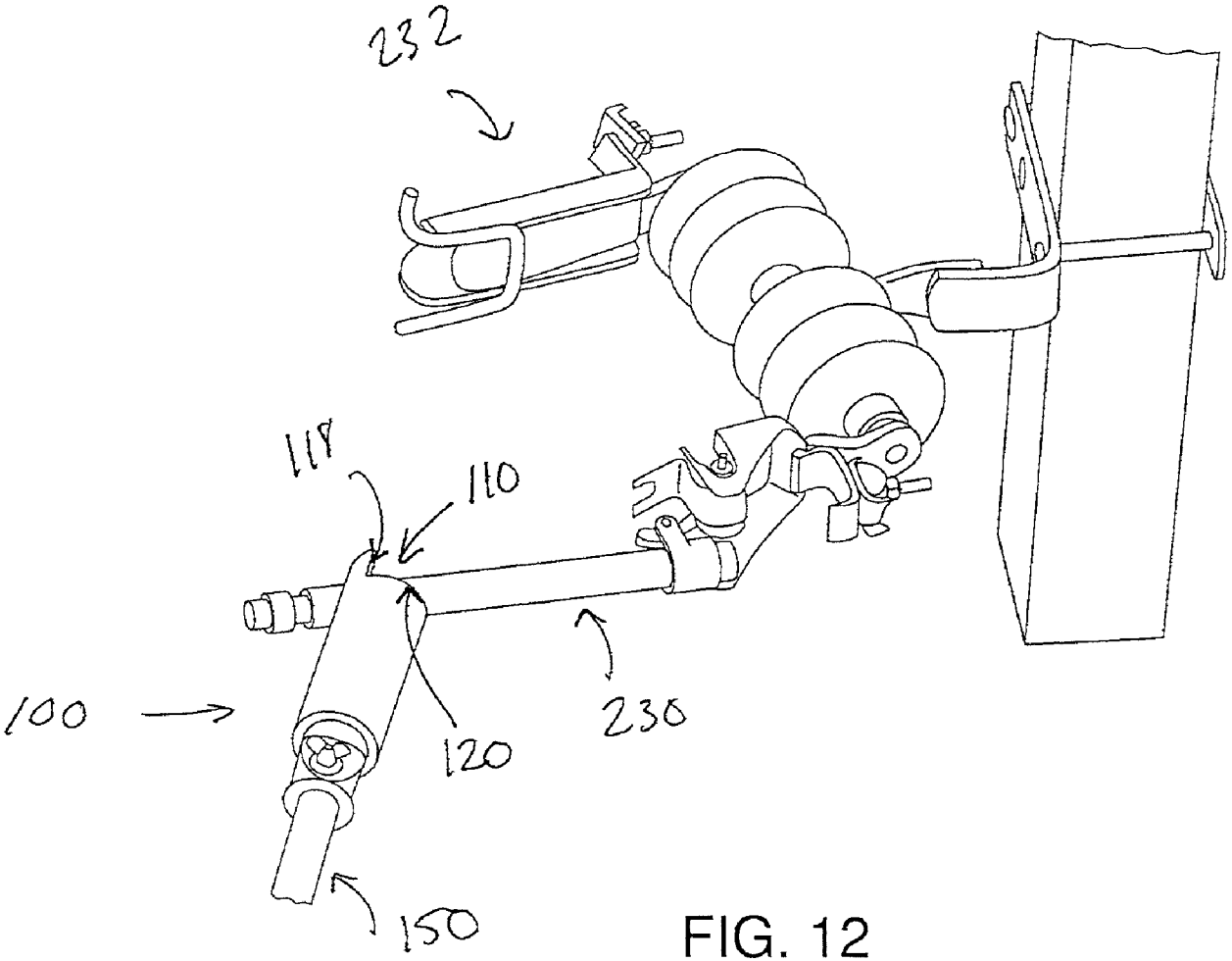
FIG. 12 depicts an isometric view of the fuse barrel component handling device of FIG. 2 during installation/removal of a fuse barrel.
Figure 13:
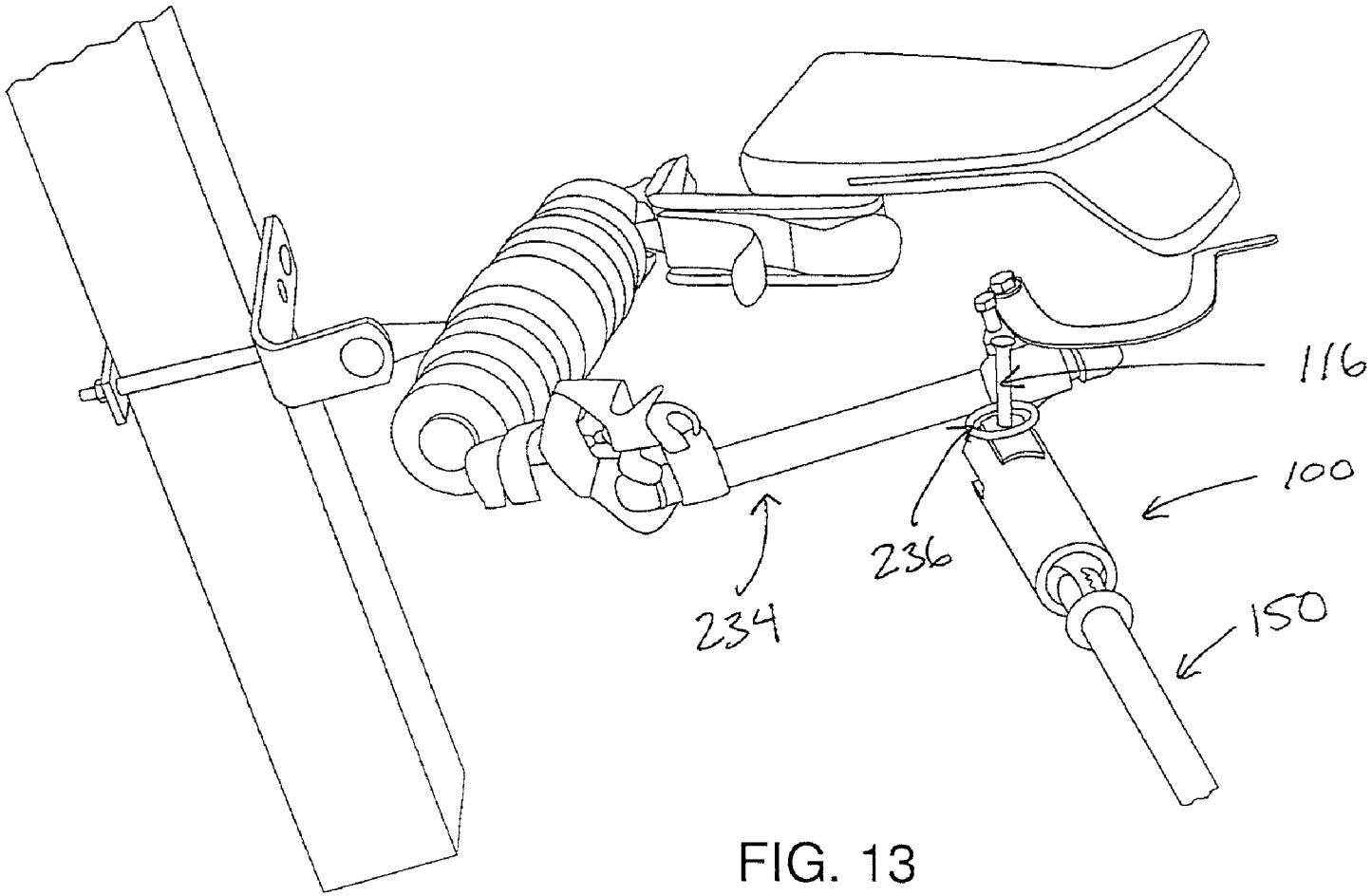
FIG. 13 depicts an isometric view of the fuse barrel component handling device of FIG. 2 during installation/removal of a load break cutout.

In addition to receiving a fuse tube (51, 202, 212, 216) within the body (102) of device (100), a fuse tube, such as the fuse tube (230) shown in FIG. 12, may be received by the notch (110) in device (100). FIG. 12 depicts a merely exemplary version of such an arrangement whereby at least a portion of the fuse tube (230) is shown to be resting along the U-shaped contour of edge (120) of notch (110). In this way, device (100) may be used to swing the fuse tube (230) upward into contact with the upper support assembly (232). The projection bar (116) of device (100) may also be used to swing a fuse tube (234), as shown in FIG. 13. In the illustrated version, projection bar (116) may be inserted through pull ring (236) to raise and/or lower the fuse tube.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, although FIG. 1 discloses a non-load break cutout (14), embodiments of fuse barrel component handling device (100) described in this application should not be limited to use with cutout (14). Such a fuse barrel component handling device (100) can be utilized to remove and/or install a non-load break component as well as a load break component, such as a load break cutout and a load break sectionalizer. For example, instead of being used to engage with a non-load break pull ring (62), a fuse barrel component handling device (100) may be used to engage and secure the hook-like portion of a load break component, such as a load break cutout or load break sectionalizer. Thus, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A system for securing a fuse barrel component, comprising:

(a) a handling device, the handling device comprising a hollow body, the hollow body comprising a wall defining an open cavity, and wherein the hollow body has a first end and a second end, wherein the first end of the hollow body comprises an opening;

a bar, the bar projecting from the first end of the hollow body;

a first slot and a second slot, the first and second slots each comprising a first edge and a second edge defining each of the first and second slots, wherein the first and second slots extend from the first end of the hollow body and through at least a portion of the wall of the hollow body; and a notch, the notch comprising a contoured surface extending from the first end of the hollow body through at least a portion of the wall of the hollow body to the first edge of the first slot;

(b) a hot stick, the hot stick being secured to the second end of the hollow body of the handling device; and (c) a fuse barrel component, the fuse barrel component comprising a cylindrical fuse tube, wherein the fuse barrel component engages at least one of the bar, the first slot, the second slot, and the notch;

wherein the opening of the first end of the hollow body is substantially free from obstructions such that the opening is configured to receive a bottom end of the cylindrical fuse tube.

2. The system of claim 1, wherein the fuse barrel component is a non-load break cutout.

3. The system of claim 1, wherein the fuse barrel component is a non-load break sectionalizer.

4. The system of claim 1, wherein the fuse barrel component includes a pull ring that is engaged with the handling device.

5. The system of claim 1, wherein the fuse barrel component is a load-break cutout.

6. The system of claim 1, wherein the fuse barrel component is a load-break sectionalizer.

7. The system of claim 1, wherein the fuse barrel component includes a hook member that is engaged with the handling device.

8. The system of claim 1, wherein the handling device further comprises an attachment at its second end, and wherein the hot stick is secured to the handling device via the attachment.

* * * * *